US010636357B1

(12) United States Patent
Brownlow et al.

(10) Patent No.: US 10,636,357 B1
(45) Date of Patent: Apr. 28, 2020

(54) ANALOGUE EXTERNAL COMPENSATION SYSTEM FOR TFT PIXEL OLED CIRCUIT

(71) Applicant: Sharp Kabushiki Kaisha, Osaka (JP)

(72) Inventors: Michael James Brownlow, Oxford (GB); Tong Lu, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/214,449

(22) Filed: Dec. 10, 2018

(51) Int. Cl.
*G09G 3/36* (2006.01)
*G09G 3/325* (2016.01)
*G09G 3/32* (2016.01)

(52) U.S. Cl.
CPC ..... *G09G 3/325* (2013.01); *G09G 3/32* (2013.01); *G09G 2300/0819* (2013.01); *G09G 2320/0233* (2013.01)

(58) Field of Classification Search
CPC ..... G09G 3/3233; G09G 3/3241; G09G 2320/0233; G09G 3/3291; G09G 2320/045; G09G 3/325; G09G 2320/0223; G09G 2320/0295; G09G 2300/0866; G09G 2320/041
USPC ..... 345/76–84
See application file for complete search history.

(56) References Cited

U.S. PATENT DOCUMENTS 6,433,488 B1 8/2002 Bu
7,414,599 B2 8/2008 Chung et al.
7,876,292 B2 * 1/2011 Cho ..... H01L 27/32 345/76
9,336,717 B2 5/2016 Chaji
9,997,106 B2 6/2018 Chaji
10,078,984 B2 * 9/2018 Nathan ..... H05B 33/08
10,339,895 B2 * 7/2019 Tai ..... G09G 5/10
2018/0254006 A1 * 9/2018 Hwang ..... G09G 3/3233

* cited by examiner

*Primary Examiner* — Duc Q Dinh
(74) *Attorney, Agent, or Firm* — Renner, Ott, Boisselle & Sklar, LLP

(57) ABSTRACT

A display system includes a pixel circuit and an analogue external compensation system that is operable with the pixel circuit to compensate for differences in a property of the drive transistor and/or light-emitting device. The display system includes a pixel circuit having a drive transistor configured to control an amount of current to a light-emitting, and an analogue external compensation system that is operable with the pixel circuit. The analogue external compensation system includes a current regulator that regulates a current applied to a first terminal of the pixel circuit to approximate a current supplied through the drive transistor to the light-emitting device; a current mirror that receives the current from the regulator and mirrors said current from the regulator to output a mirrored current; a current source that supplies a programming reference current; and an integrator that receives inputs of the mirrored current and the programming reference current. The integrator converts a difference between the mirrored current and the programming reference current to an adjusted data voltage that is applied to a second terminal of the pixel circuit to compensate for a variation in a property of the drive transistor and/or the light-emitting device.

20 Claims, 7 Drawing Sheets

ANALOGUE EXTERNAL COMPENSATION SYSTEM FOR TFT PIXEL OLED CIRCUIT

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through a drive transistor. In one example, an input signal, such as a high "SCAN" signal, is employed to switch transistors in the circuit to permit a data voltage, VDAT, to be stored at a storage capacitor during a programming phase. When the SCAN signal is low and a switch transistor isolates the circuits from the data voltage, the VDAT voltage is retained by the capacitor and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{OLED} - V_{TH})^2$$

TFT device characteristics, especially the TFT threshold voltage $V_{TH}$, may vary, for example due to manufacturing processes and/or stress and aging of the TFT device during the operation. With the same VDAT voltage, the amount of current delivered by the TFT drive transistor could vary by a large amount due to such threshold voltage variations. Therefore, pixels in a display may not exhibit uniform brightness for a given VDAT value. In addition, OLED device characteristics may vary due to manufacturing processes, and/or stress and aging during the operation of the OLED. For example, the threshold voltage of the OLED for light emission may change. Conventional circuit configurations, therefore, often include elements that operate to compensate for at least some of these component variations to achieve an OLED display with more uniform brightness among sub-pixels.

Accordingly, there are various methods that have been employed to compensate for the drive TFT and OLED variations. Normally, such methods use a circuit configuration having several transistors. The size required by many of these circuit configurations may not be suitable for high resolution displays having high pixels per inch (ppi), in which each subpixel occupies only a small area. With a small area and limited number of transistors, external measurement and compensation may be used to measure the circuit performance and device properties, such as threshold voltage and mobility of the drive transistor and the OLED. An external circuit, therefore, may be used to generate a compensated data signal according to those measurements for appropriate compensation.

One approach for external compensation is described in U.S. Pat. No. 6,433,488 (Bu, issued Aug. 13, 2002). During measurements, the current to the OLED is diverted to an external current comparator and compared with a reference current. An output data voltage is used to adjust the current through the drive transistor. This approach is deficient, however, because the current is diverted from the OLED, and thus the OLED properties are not measured. The drive transistor may not work in the same condition as in the emission phase, and thus the compensation measurements may not be accurate.

Another approach for external compensation is described in U.S. Pat. No. 7,876,292 (Cho et al., issued Jan. 25, 2011). During the measurement stage, the current through the OLED is sensed and compared with a reference current and then the difference is converted to a data voltage. This data voltage is then applied to the gate of the drive transistor. This approach also is deficient because the anode and cathode of the OLED have to connect to the pixel circuit. During the manufacturing process, normally only one of the nodes, the anode or cathode, is accessible from the pixel circuit, and thus compensation during use may not be sufficiently accurate.

Another approach for external compensation is described in U.S. Pat. No. 9,336,717 (Chaji, issued May 10, 2016). A monitor line is used to monitor the current through the drive transistor while the OLED is turned off. The programming data voltage is adjusted according to the monitored current. This approach is deficient because the pixel circuits have five transistors, and thus the number of transistors is undesirably high for use with an external compensation scheme.

Another approach for external compensation is described in U.S. Pat. No. 9,997,106 (Chaji, issued Jun. 12, 2018). A monitor line is used to monitor the current through the drive transistor while the OLED is turned off. The programming data voltage is adjusted according to the monitored current. In the pixel circuits, the storage capacitor is connected between the source and gate of the drive transistor. This approach is deficient because the parasitic capacitance of the OLED could affect the charge distribution between the storage capacitor and the parasitic capacitors. The OLED mismatch could cause more variations in light emission than other methods.

It is desirable that the programming time for the pixel circuitry be as short as possible for optimal performance of the display system. A significant challenge with respect to conventional external compensation systems is minimizing the programming time while maintaining a compact pixel circuit arrangement.

SUMMARY OF INVENTION

The present invention relates to an enhanced analogue external compensation system that can compensate for variations in properties of components of a pixel circuit of a display device. The analogue external compensation system in particular compensates for variations in properties of the drive transistor and light-emitting device (such as for example an OLED) of the pixel circuit. Current that flows through the drive transistor and the OLED in the pixel circuit is measured and sensed through a duplicate voltage supply line from the analogue external compensation system. The duplicate voltage supply line is configured to have the same voltage as the pixel circuit supply voltage for the array of pixel circuits.

The measured and sensed current through the duplicate supply line is sensed by the analogue external compensation system by comparing the measured current with a programming reference current that also is inputted into the analogue external compensation system. The difference between the measured and programming currents is converted to an adjusted data voltage, which is applied to the gate of the drive transistor to control the current through the OLED. The adjusted data voltage is continuously changing and being updated based on such current difference. The adjusted data voltage becomes stable when the current difference becomes smaller than the system resolution, and thus the current flow through the OLED is comparable to the programming reference current, which compensates for variations in the components of the pixel circuit (e.g., drive transistor and OLED) as referenced above.

During data programming and control signal switching, there is no excessive current flowing through the OLED, which improves the reliability and the life time of OLED. In addition, the analogue external compensation system operates with pixel circuits that include a few as four transistors and one capacitor so as to fit within a small area. The analogue external compensation unit is an external module relative to the display panel of pixels. The analogue external compensation unit further may be configured as an integrated circuit chip. Generally, the current that flows through the duplicate power supply to the pixel circuit is sensed in the analogue external compensation unit for compensation of variations in the properties of components of the pixel circuit.

In exemplary embodiments, the analogue external compensation system includes a current regulator that regulates the current to approximate the OLED current. The current regulator sends the regulated current to a current mirror, which mirrors the current flow outputted by the current regulator. A current source supplies a programming reference current, and the mirrored current and programming reference current are supplied to an integrator that compares the two currents. The integrator converts the current difference between the mirrored current and the programming reference current to an adjusted data voltage, which is supplied to a drive transistor of the pixel circuit to control the current through the OLED for light emission. In this manner, the use of the analogue external compensation system provides effective compensation for variations in the properties of the components of the pixel circuit, including in particular the drive transistor and light-emitting device (OLED). The compensation is performed effectively while maintaining a compact pixel circuit that is suitable for high resolution display devices.

An aspect of the invention, therefore, is a display system comprising a pixel circuit and an analogue external compensation system that is operable with the pixel circuit to compensate for differences in a property of the drive transistor and/or light-emitting device. In exemplary embodiments, the display system includes a pixel circuit having a drive transistor configured to control an amount of current to a light-emitting device depending upon a voltage applied to a gate of the drive transistor, and an analogue external compensation system that is operable with the pixel circuit. The analogue external compensation system includes a current regulator that regulates a current applied to a first terminal of the pixel circuit to approximate a current supplied through the drive transistor to the light-emitting device; a current mirror that receives the current from the regulator and mirrors said current from the regulator to output a mirrored current; a current source that supplies a programming reference current; and an integrator that receives inputs of the mirrored current and the programming reference current. The integrator converts a difference between the mirrored current and the programming reference current to an adjusted data voltage that is applied to a second terminal of the pixel circuit to compensate for a variation in a property of the drive transistor and/or the light-emitting device.

In exemplary embodiments, the current regulator includes a first operational amplifier (Op-amp) and a regulator transistor which may be an n-type transistor. A positive input terminal of the first Op-amp is connected to a pixel voltage supply; a negative input terminal of the first Op-amp is connected to a first terminal of the regulator transistor and the first terminal of the pixel circuit; a second terminal of the regulator transistor is connected to the current mirror; and an output of the first Op-amp is connected to a gate of the regulator transistor. Further in exemplary embodiments, the integrator comprises a resistor, a capacitor, and a second Op-amp. A first terminal of the resistor is connected to the current source and a second terminal of the resistor is connected to a positive input of the second Op-amp and the capacitor; the capacitor is connected between the positive input of the second Op-amp and an output of the second Op-amp; a negative input of the second Op-amp is connected to a reference voltage supply that supplies a DC bias; and the output of the second Op-amp is connected to the second terminal of the pixel circuit.

Another aspect of the invention is a method of operating a display system comprising a pixel circuit and an analogue external compensation system that is operable with the pixel circuit according to any of the embodiments. The method of operating includes operating during a current sensing and data programming phase, and an emission phase for light emission. The method includes, during the current sensing and data programming phase: disconnecting the drive transistor from a pixel voltage supply input and connecting the drive transistor to the analogue external compensation system via a first terminal of the pixel circuit; regulating with the current regulator a current applied to the first terminal of the pixel circuit to approximate a current supplied through the drive transistor to the light-emitting device; mirroring with the current mirror the current from the current regulator and outputting a mirrored current; supplying a programming reference current with the current source; and inputting the mirrored current and the programming reference current to the integrator, wherein the integrator converts a difference between the mirrored current and the programming reference current to an adjusted data voltage that is applied to a second terminal of the pixel circuit to compensate for a variation in a property of the drive transistor and/or the light-emitting device. The method further includes, during the emission phase, disconnecting the drive transistor from the first terminal of the pixel circuit and connecting the drive transistor to the pixel voltage supply input, wherein the adjusted data voltage is applied to the gate of the drive transistor via the second terminal of the pixel circuit to control the current through the light emitting device.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
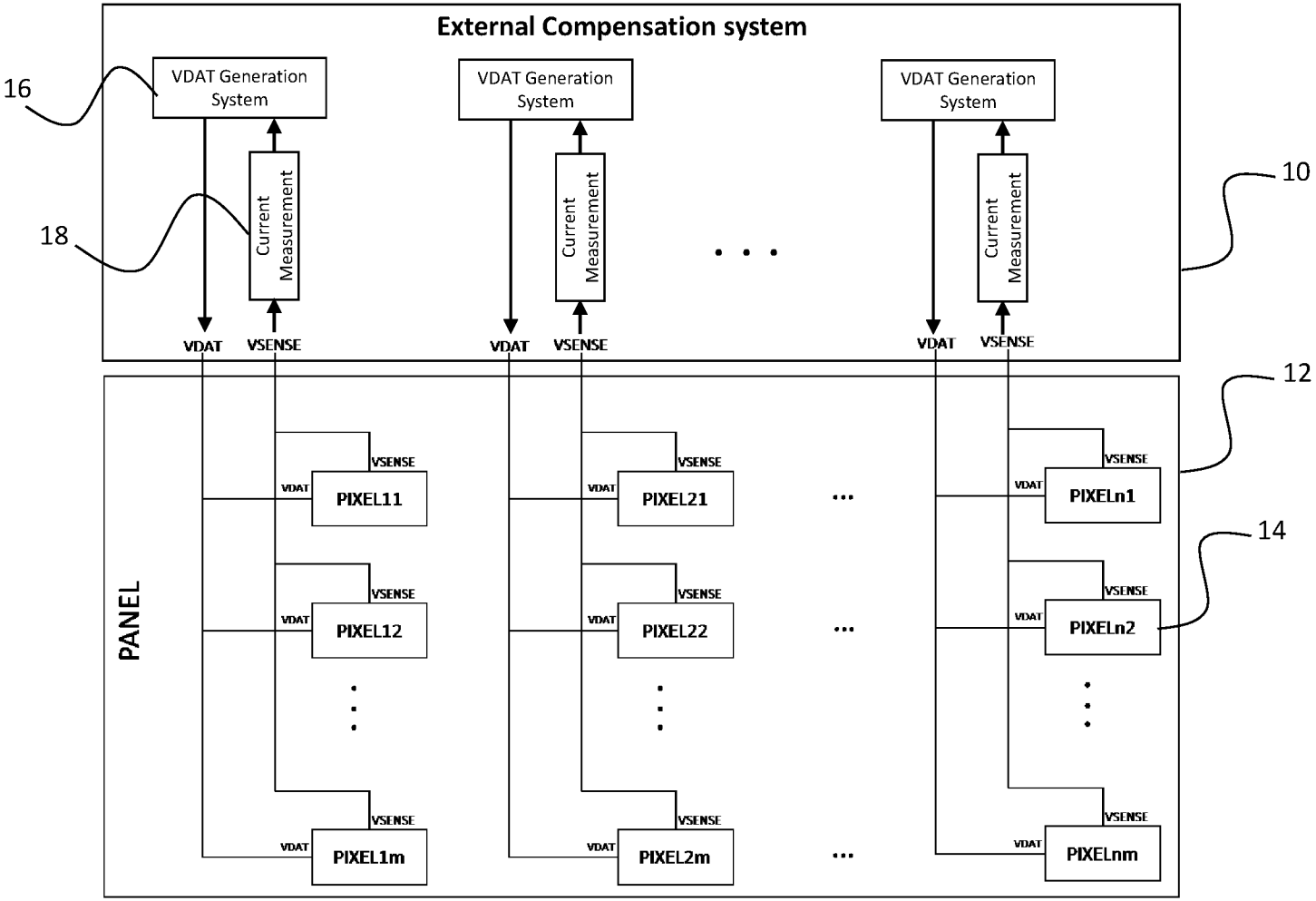
FIG. 1 is a drawing depicting an exemplary display system including an external compensation system and a display panel including a pixel array of pixels arranged in "n" columns by "m" rows.

Embodiments of the present invention will now be described with reference to the drawings, wherein like reference numerals are used to refer to like elements throughout. It will be understood that the figures are not necessarily to scale.

FIG. 1 is a drawing depicting a display system including an external compensation system 10 and a display panel 12 including a pixel array of pixels 14 arranged in "n" columns by "m" rows. As further detailed below, control signals applied to the rows enable each row, one row at a time from a first row to the last row, to be programmed to generate one image frame. A data voltage VDAT is applied from a VDAT generation system 16 in the column during a scan period for each row. The data voltage in the column will change to corresponding image data for the next row. Also during the scan period, each pixel has a sense line through which a current flows through a duplicate supply voltage line VSENSE to the OLED in the pixel, and the current that flows through the VSENSE line is measured or sensed in the external compensation system 10 using a current measurement device 18. The pixels in one column share one sense line, and thus when there are n columns in the display panel 12, there will be n sense lines. The current in each pixel 14 only is sensed when the corresponding row is selected. For each sense line, there is only one pixel sensed at any time as selected by application of the appropriate control signal. Details and various embodiments of this overall system configuration are described with respect to the subsequent figures below.

Figure 2:
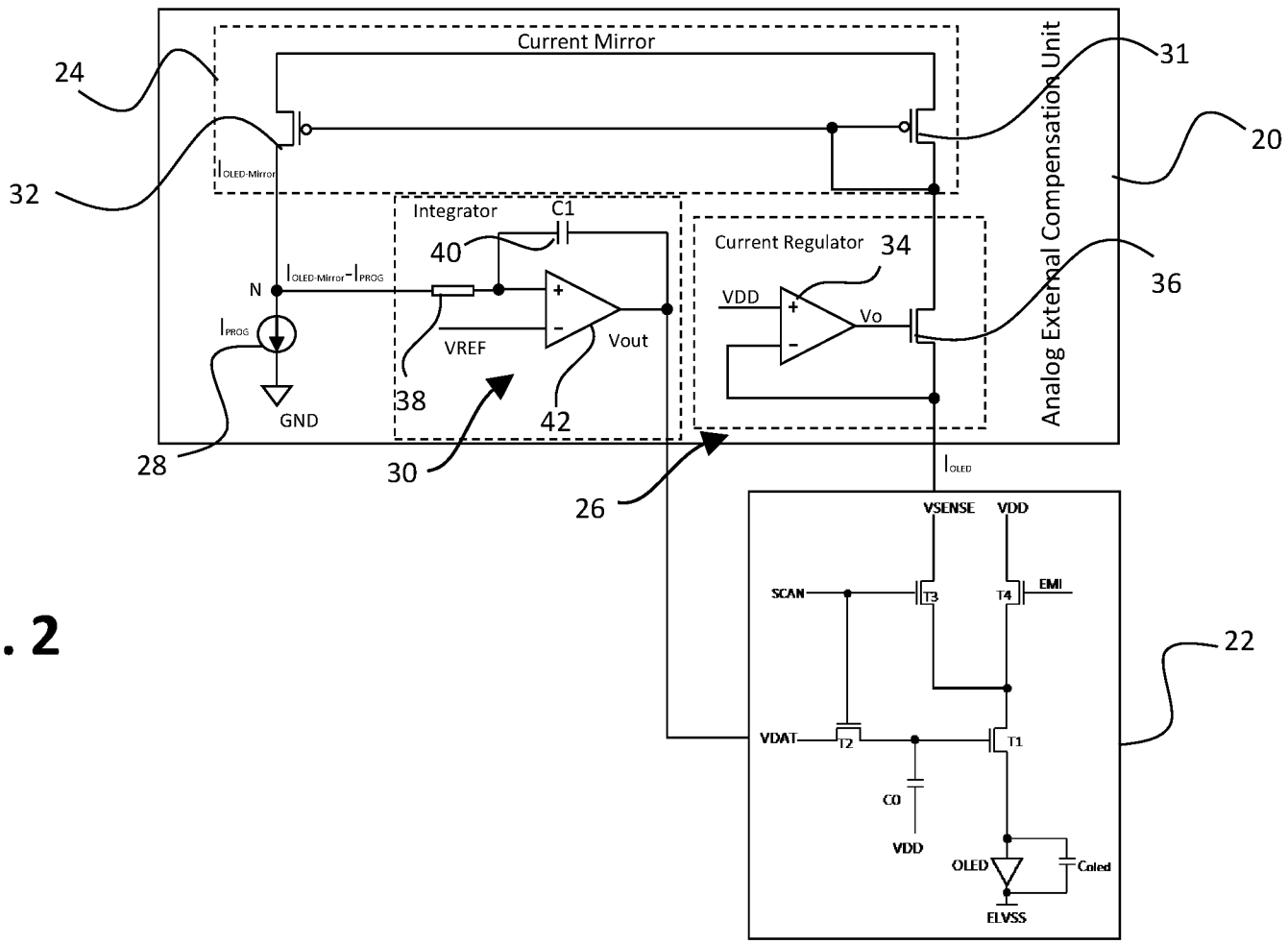
FIG. 2 is a drawing depicting an exemplary display system including an analogue external compensation system in combination with a first pixel circuit in accordance with embodiments of the present invention.

FIG. 2 is a drawing depicting a display system including an exemplary analogue external compensation system 20 in combination with a first pixel circuit 22 in accordance with embodiments of the present invention. Generally, current flows through a duplicate supply line at a first terminal VSENSE of pixel circuit 22 to the OLED, the current through the VSENSE terminal being denoted $I_{OLED}$. This current to the OLED is sensed in the analogue external compensation system 20 using a current mirror 24, and ultimately the analogue external compensation system 20 supplies a data voltage through a second terminal VDAT of the pixel circuit 22. The configuration and operation of the analogue external compensation system 20 is described in detail below.

Figure 3:
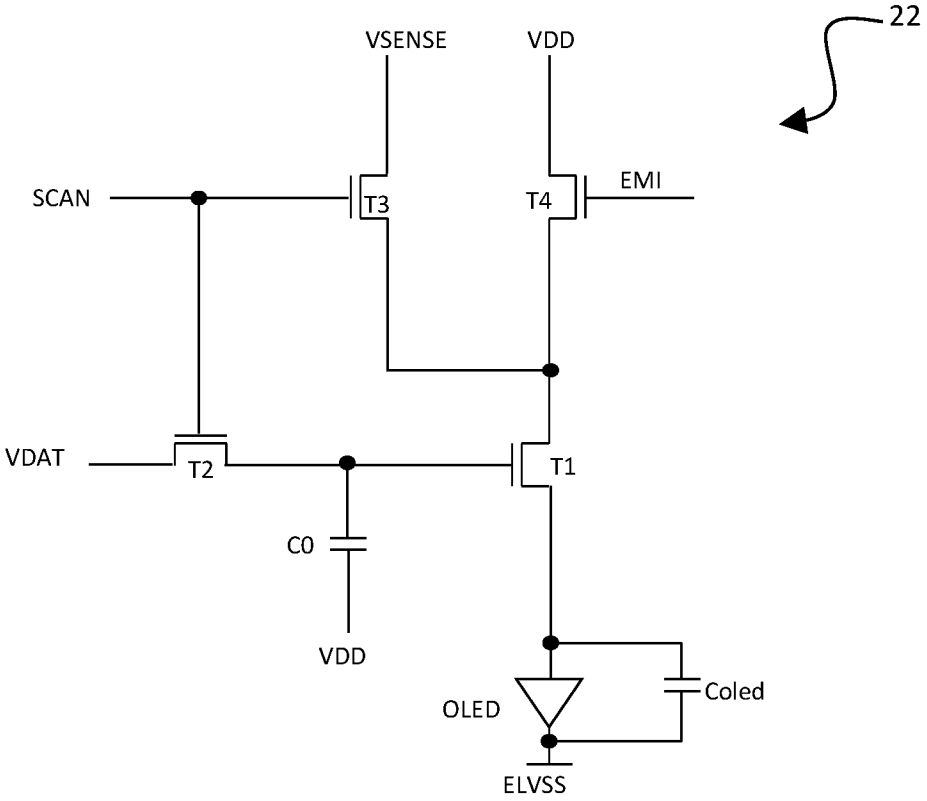
FIG. 3 is a drawing depicting the first pixel circuit configuration as shown in FIG. 2 in accordance with embodiments of the present invention.
Figure 4:
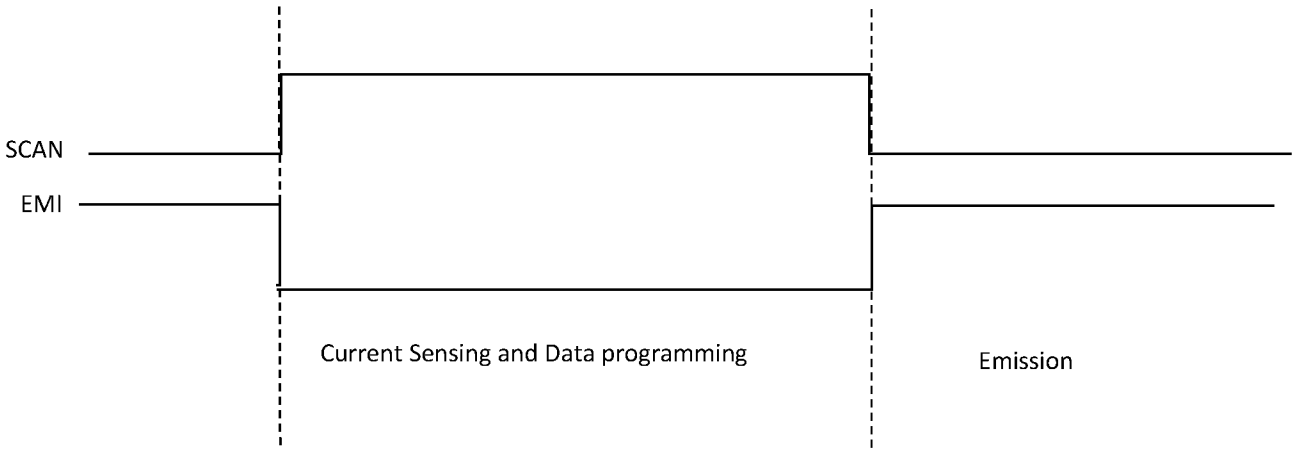
FIG. 4 is a drawing depicting a timing diagram illustrating the operation of the pixel circuit of FIG. 3.

FIG. 3 is a drawing depicting the first pixel circuit configuration 22 as shown in FIG. 2 in accordance with embodiments of the present invention. FIG. 4 is a drawing depicting a timing diagram illustrating the operation of the pixel circuit 22 of FIG. 3. In this example, the pixel circuit 22 is configured as a thin film transistor (TFT) circuit that includes multiple n-type transistors T1-T4 and one capacitor $C_0$. The circuit elements drive a light-emitting device, such as for example an OLED. The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 3 depicts the TFT pixel circuit 22 configured with multiple n-MOS or n-type TFTs. T1 is a drive transistor that is an analogue TFT, and T2-T4 are digital switch TFTs. As referenced above, $C_0$ is a capacitor, and $C_{oled}$ is the internal capacitance of the OLED device (i.e., $C_{oled}$ is not a separate component, but is inherent to the OLED). The OLED further is connected to a first power supply ELVSS as is conventional.

The OLED and the TFT pixel circuit 22, including the transistors, capacitors and connecting wires, may be fabricated using TFT fabrication processes conventional in the art. It will be appreciated that comparable fabrication processes may be employed to fabricate the TFT circuits according to any of the embodiments.

For example, the TFT pixel circuit 22 (and subsequent embodiments) may be disposed on a substrate such as a glass, plastic, or metal substrate. Each TFT may comprise a gate electrode, a gate insulating layer, a semiconducting layer, a first electrode, and a second electrode. The semiconducting layer is disposed on the substrate. The gate insulating layer is disposed on the semiconducting layer, and the gate electrode may be disposed on the insulating layer. The first electrode and second electrode may be disposed on the insulating layer and connected to the semiconducting layer using vias. The first electrode and second electrode respectively may commonly be referred to as the "source electrode" and "drain electrode" of the TFT. The capacitor may comprise a first electrode, an insulating layer and a second electrode, whereby the insulating layer forms an insulating barrier between the first and second electrodes. Wiring between components in the circuit, and wiring used to introduce signals to the circuit (e.g. SCAN, EMI, VDAT) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The OLED device may be disposed over the TFT circuit. The OLED device may comprise a first electrode (e.g. anode of the OLED), which is connected to transistor T1 in this example, one or more layers for injecting or transporting charge (e.g. holes) to an emission layer, an emission layer, one or more layers for injecting or transporting electrical charge (e.g. electrons) to the emission layer, and a second electrode (e.g. cathode of the OLED), which is connected to first power supply ELVSS in this example. The injection layers, transport layers and emission layer may be organic materials, the first and second electrodes may be metals, and all of these layers may be deposited by a thermal evaporation technique.

Referring to the TFT pixel circuit 22 of FIG. 3 in combination with the timing diagram of FIG. 4 and the analogue external compensation system 20 of FIG. 2, the pixel circuit 22 operates to perform in two phases: (1) a current sensing and data programming phase, and (2) an emission phase for light emission. In this first embodiment, during the previous emission phase, a control signal EMI signal level has a high voltage value, so transistor T4 is in an on state to apply the emission current from the pixel voltage supply input VDD through the drive transistor to the OLED. A control signal SCAN signal level has a low voltage value so transistors T2 and T3 are in an off state.

At the beginning of the current sensing and data programming phase, the EMI signal level is changed from the high voltage value to the low voltage value, causing transistor T4 to be turned off. With transistor T4 turning off, the power supply, VDD, is disconnected from the pixel circuit.

Then, the SCAN signal level is changed from the low voltage value to the high voltage value, causing transistors T3 and T2 to be turned on. With transistor T3 turning on, the pixel is connected at the first terminal to the duplicate power supply VSENSE as supplied by the analogue external compensation system 20 of FIG. 2. With transistor T2 turning on, the pixel is connected at the second terminal to the data voltage, VDAT, which is connected to the gate of the drive transistor T1 through T2 and to the storage capacitor, $C_0$. With applying VDAT at the gate of the drive transistor, a current may flow from the duplicate power supply VSENSE through transistor T3 and through the drive transistor T1 to the OLED.

As shown in FIG. 2, the analogue external compensation unit 20 is an external module relative to the display panel 12 of pixels 14. The analogue external compensation unit 20 further may be configured as an integrated circuit chip. Generally, the current that flows through the duplicate power supply VSENSE is sensed in the analogue external compensation unit 20. The analogue external compensation unit 20 includes the current mirror 24 as referenced above, a current regulator 26 that functions as a current sensing unit, a current source 28, and an integrator 30.

Any suitable current mirror 24 of the analogue external compensation unit 20 may be employed, and as shown in FIG. 2 the current mirror 24 may include two p-type transistors 31 and 32, with the output of the current mirror 24 $I_{OLED\text{-}Mirror}$ approximating the current through the OLED, $I_{OLED}$ as further detailed below. The current mirror shown in the FIG. 2 is an exemplary simple current mirror, the structure of which is an example shown only for illustration purposes. Actual implementation of the current mirror 24 may be any suitable high-accuracy current mirror for minimizing the error between the outputted mirrored current $I_{OLED_Mirror}$ and the OLED current $I_{OLED}$.

In exemplary embodiments as shown in FIG. 2, the current regulator 26 includes a first operational amplifier (Op-amp) 34 and a regulator transistor 36, which may be an n-type transistor. In the depicted configuration of FIG. 2, a positive input terminal of the first Op-amp is connected to the pixel voltage supply input; a negative input terminal of the first Op-amp is connected to a first terminal of the regulator transistor and the first terminal of the pixel circuit; a second terminal of the regulator transistor is connected to the current mirror; and an output of the first Op-amp is connected to a gate of the regulator transistor. Referring to FIG. 2, the positive input terminal of the first Op-amp 34 is connected to VDD, which is the supply voltage for the pixel circuit 22. The negative input terminal of the first Op-amp 34 is connected to the first terminal of the n-type regulator transistor 36, which also is the VSENSE first terminal to the pixel circuit 22. The output of the first Op-amp 34 $V_o$ is connected to the gate of the n-type regulator transistor 36. With such configuration, the difference between the two input terminals, which voltage levels are VDD and VSENSE, of the Op-amp 34 is equal to $$VDD - VSENSE = \frac{V_o}{A}$$

wherein "A" is the gain of the first Op-amp 34. Such gain typically is larger than 1000 and up to 100,000 depending on the Op-amp design, and thus $V_o$ is within the operating range of the integrated circuit chip containing the analogue external compensation unit 20, which is approximately a few volts. In this manner, the difference between the VDD and VSENSE is very small and essentially negligible.

As the pixel circuit drive transistor T1 is an n-type TFT, the current through the OLED in first order is $$I_{OLED}=\beta(V_{DAT}-V_{OLED}-V_{TH})^2$$

The voltage between the drain and source of the drive transistor T1, $V_{ds}$, is only a second order, and thus a difference of $V_{ds}$ causes only a small current variation. Accordingly, even when there are small differences between VDD and VSENSE, the OLED current $I_{OLED}$ could be still similar with such difference when VDD is connected to the pixel, such that $V_{ds}=V_{DD}-V_{OLED}$.

The OLED current $I_{OLED}$ also flows through the n-type transistor 36 in the current regulator 26 to the current mirror 24 of the analogue external compensation unit 20. The first Op-amp 34 in the current regulator 26 adjusts the output voltage applied to the gate of the n-type transistor 36 to have the current value equal to the sensed OLED current $I_{OLED}$. This sensed current is then mirrored by the current mirror 24, and this mirrored current is inputted to the integrator 30 of the analogue external compensation system 20. The mirrored current of the current mirror 24, $I_{OLED_MIRROR}$ is compared with a programming reference current $I_{prog}$ from the current source 28, the reference current also being inputted to the integrator 30. Generally, a level of the programming reference current corresponds to an image data grey level of the image data for the corresponding image frame. The difference between the mirrored OLED current, $I_{OLED_MIRROR}$ and the programming reference current, $I_{PROG}$ is thus applied to the integrator 30.

As shown in FIG. 2, the integrator 30 may include a resistor 38, a capacitor 40 having capacitance C1, and a second Op-amp 42. In the depicted configuration of FIG. 2, a first terminal of the resistor is connected to the current source and a second terminal of the resistor is connected to a positive input of the second Op-amp and the capacitor; the capacitor is connected between the positive input of the second Op-amp and an output of the second Op-amp; a negative input of the second Op-amp is connected to a reference voltage supply VREF that supplies a DC bias; and the output of the second Op-amp is connected to the second terminal of the pixel circuit. Referring again to FIG. 2, the resistor 38 is connected between the positive input terminal of the second Op-amp 42 and a node "N" at which the mirrored OLED current $I_{OLED_MIRROR}$ and the programming reference current $I_{PROG}$ are connected. The capacitor 40 (C1) is connected between the positive input terminal of the second Op-amp 42 and the output of the second Op-amp 42.

With such configuration, the relationship between the output of the integrator 30 and the current input to the integrator 30 is $$V_{out} = \frac{1}{C1}\int (I_{OLED_MIRROR} - I_{PROG})dt$$

The output of the integrator 30 is applied through the second terminal VDAT of the pixel circuit 22, and through T2 to the gate of the drive transistor T1 as an adjusted data voltage. As the data voltage is changing with the output of the integrator 30, the resultant controlled OLED current, $I_{OLED}$ is changing towards the programming current $I_{PROG}$. The output voltage $V_{out}$ of the integrator 30 (the adjusted VDAT data voltage) continues rising or falling in the direction of forcing the OLED current, $I_{OLED}$ to be equal to the programming reference current, $I_{PROG}$. When the current difference is smaller than the system resolution, the integrator output becomes a stable voltage, and the current sensing thereby compensates for any variations of the drive transistor and OLED properties.

Accordingly, during the current sensing and data programming phase, the current supplied from the current regulator to the first terminal of the pixel circuit is controlled by the adjusted data voltage based on forcing the current in a direction of toward the programming reference current. When a difference between the current supplied from the current regulator to the first terminal of the pixel circuit and the programming reference current becomes smaller than a resolution of the display system, the adjusted data voltage becomes a stable voltage. During the emission phase, the current through the light-emitting device approximates the programming reference current, and as referenced above, a level of the programming reference current corresponds to an image data grey level. In essence, therefore, during the current sensing and data programming phase, a test current is applied through the VSENSE terminal of the pixel circuit to the OLED. The test current can be the current from a previous frame or a current that is initiated by an initial data voltage from the analogue compensation system. The test current is mirrored and applied to the integrator for comparison to the programming reference current. As the currents are similar and optimally should be the same, the difference of the two currents is used to adjust the VDAT to an optimal level, and such data voltage is applied via the second pixel terminal to the drive transistor of the pixel circuit. The adjusted and optimized VDAT is then used in the emission phase for light emission.

At the end of the current sensing and the data programming phase, the SCAN signal level is changed from the high voltage value to the low voltage value, causing transistors T2 and T3 to be turned off. With transistor T2 turning off, the VDAT input is disconnected from the gate of drive transistor T1, and the voltage VDAT is stored at the top plate of the storage capacitor $C_0$ for the emission phase. The bottom plate of the capacitor $C_0$ is connected to a voltage supply, such as the pixel voltage supply input VDD. Alternatively, the voltage supply can be another independent supply, such as VREF. As described above, the VDAT voltage is the optimized voltage for the drive transistor to output the defined programming reference current. With transistor T3 turning off, the pixel is disconnected from the duplicate power supply VSENSE.

At the beginning of the emission phase, the EMI signal level is changed from the low voltage value to the high voltage value, causing transistor T4 to be turned on. With T4 turning on, the pixel is connected to the pixel voltage supply input VDD, and current will flow from VDD through the drive transistor T1 and to the OLED. The current flowing through the pixel is approximate to the programming reference current based on the operation during the current sensing and data programming phase. Accordingly, any threshold or mobility variations of the drive transistor and OLED are compensated and do not affect the programmed current in the pixel. The analogue external compensation system 20 sequentially operates to the next pixel for current sensing and data programming, until the pixels in the selected row are all sensed.

Figure 5:
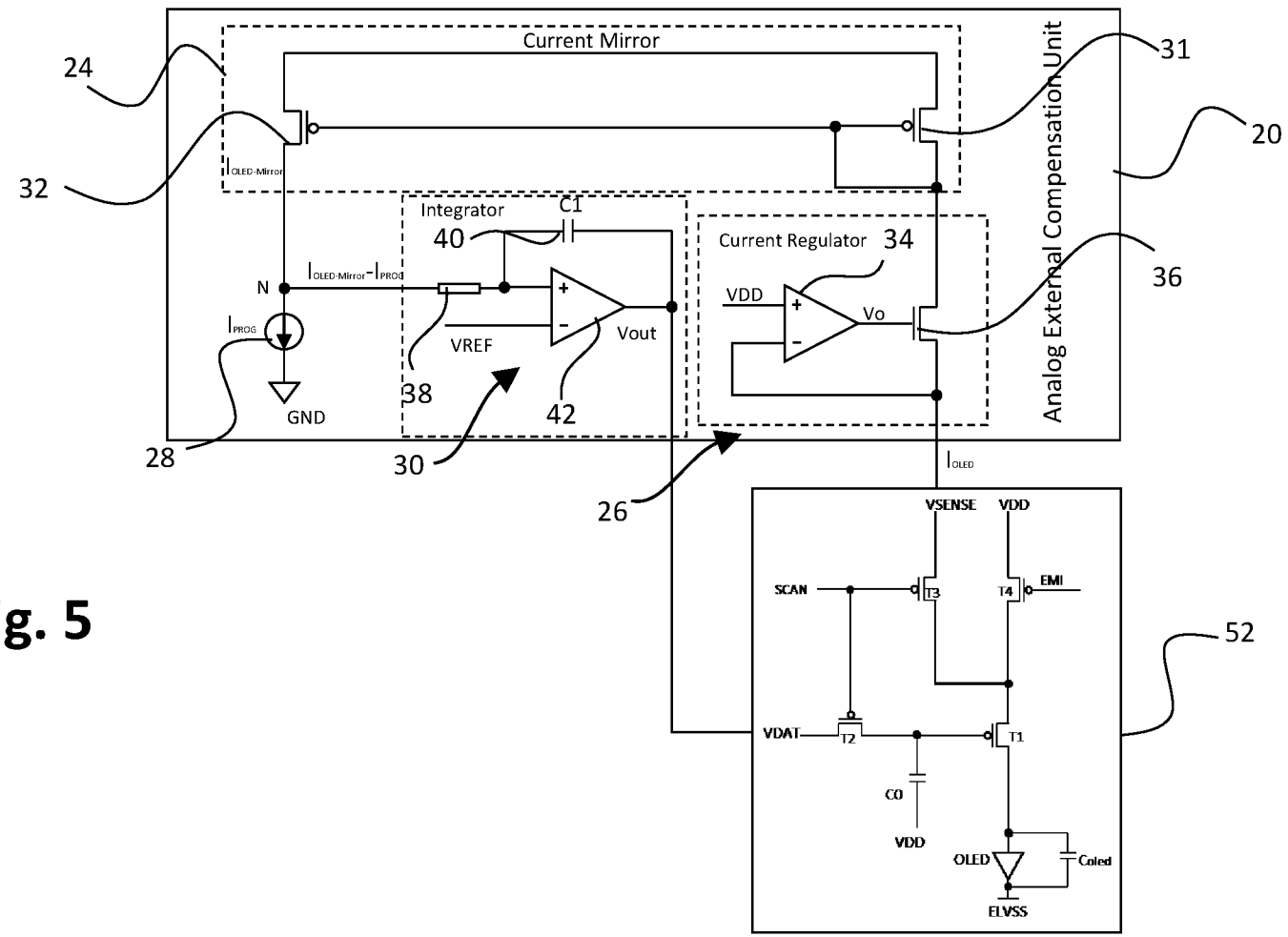
FIG. 5 is a drawing depicting another exemplary display system including the analogue external compensation system of FIG. 2 in combination with a second pixel circuit in accordance with embodiments of the present invention.
Figure 6:
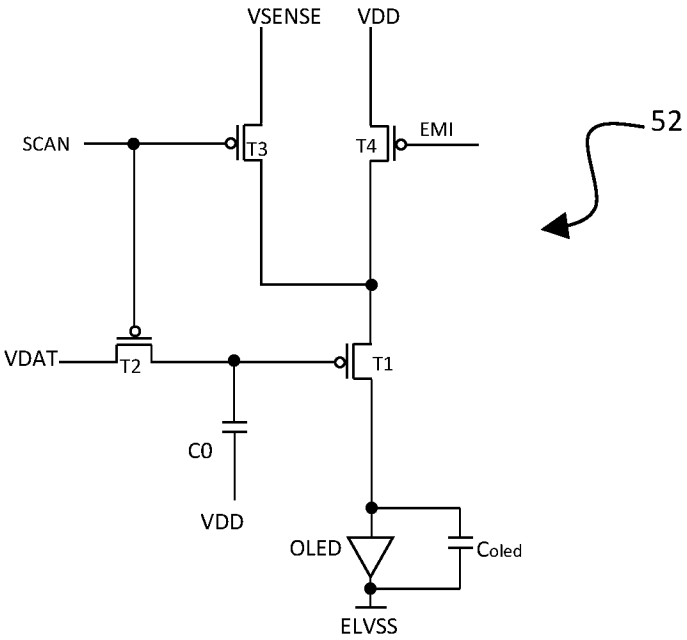
FIG. 6 is a drawing depicting the second pixel circuit configuration as shown in FIG. 5 in accordance with embodiments of the present invention.
Figure 7:
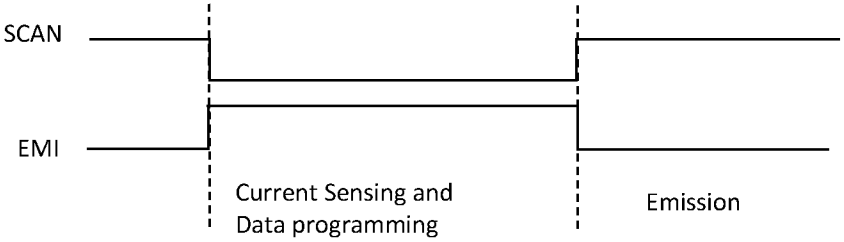
FIG. 7 is a drawing depicting a timing diagram illustrating the operation of the pixel circuit of FIG. 6.

FIG. 5 is a drawing depicting another exemplary display system including the analogue external compensation system 20 of FIG. 2 in combination with a second pixel circuit 52 in accordance with embodiments of the present invention. FIG. 6 is a drawing depicting the second pixel circuit configuration 52 as shown in FIG. 5, and FIG. 7 is a drawing depicting a timing diagram illustrating the operation of the pixel circuit of FIG. 6. The analogue external compensation system 20 is configured comparably in the embodiments of FIGS. 2 and 5. In addition, the circuit configuration 52 of FIG. 6 operates comparably as the circuit configuration 22 of FIG. 3, except that the circuit configuration 52 employs p-type transistors rather than n-type transistors. As is known in the art, the drive properties of an OLED may be more suitable for one or other of p-type versus n-type transistors, and the principles of the present invention are applicable to either type of configuration. Accordingly, in this example, the circuit 52 is configured as a TFT circuit that includes multiple p-type transistors T1-T4 and one capacitor $C_0$. The circuit elements drive a light-emitting device, such as for example an OLED. Similarly as in the first embodiment, this embodiment is described principally in connection with an OLED as the light-emitting device, and comparable principles may be used with display technologies that employ other types of light-emitting devices, including for example micro LEDs and quantum dot LEDs.

More specifically, FIG. 6 depicts the TFT pixel circuit 52 configured with multiple p-MOS or p-type TFTs. T1 is a drive transistor that is an analogue TFT, and T2-T4 are digital switch TFTs. As referenced above, $C_0$ is a capacitor, and $C_{oled}$ is the internal capacitance of the OLED device (i.e., $C_{oled}$ is not a separate component, but is inherent to the OLED). The OLED further is connected to a first or device power supply ELVSS as is conventional. In addition, as referenced above the analogue external compensation unit 20 is an external module relative to the display panel 12 of pixels 14. The analogue external compensation unit 20 further may be configured as an integrated circuit chip.

The embodiment of FIGS. 5-7 otherwise operates comparably as the embodiment of FIGS. 2-4, with the control signals being arranged for operation using p-type transistors. Referring to the TFT pixel circuit 52 of FIG. 6 in combination with the timing diagram of FIG. 7 and the analogue external compensation system 20 of FIG. 5, the pixel circuit 52 operates to perform in two phases: (1) a current sensing and data programming phase, and (2) an emission phase for light emission. In this second embodiment, during the previous emission phase, a control signal EMI signal level has a low voltage value, so transistor T4 is in an on state to apply the emission current from the pixel voltage supply input VDD through the drive transistor to the OLED. A control signal SCAN signal level has a high voltage value so transistors T2 and T3 are in an off state.

At the beginning of the current sensing and data programming phase, the EMI signal level is changed from the low voltage value to the high voltage value, causing transistor T4 to be turned off. With transistor T4 turning off, the power supply, VDD, is disconnected from the pixel circuit.

Then, the SCAN signal level is changed from the high voltage value to the low voltage value, causing transistors T3 and T2 to be turned on. With transistor T3 turning on, the pixel is connected at the first terminal to the duplicate power supply VSENSE as supplied by the analogue external compensation system 20 of FIG. 5. With transistor T2 turning on, the data voltage, VDAT, is connected at the second terminal of the pixel circuit to the gate of the drive transistor through T2 and to the storage capacitor, $C_0$. With applying VDAT at the gate of the drive transistor, a current may flow from the duplicate power supply VSENSE through transistor T3 and through the drive transistor T1 to the OLED.

The analogue external compensation unit 20 is configured and operates comparably as described above with respect to the embodiment of FIG. 2. Generally, the current that flows through the duplicate power supply VSENSE is sensed in the analogue external compensation unit 20. The analogue external compensation unit 20 again includes the current mirror 24, the current regulator 26 that functions as a current sensing unit, the current source 28, and the integrator 30. The current regulator 26 again includes a first operational amplifier (Op-amp) 34 and a regulator transistor 36, which may be an n-type transistor. The positive input terminal of the first Op-amp 34 is connected to VDD, which is the supply voltage for the pixel circuit 52. The negative terminal of the first Op-amp 34 is connected to the source terminal of the n-type regulator transistor 36, which also is the VSENSE first terminal to the pixel circuit 52. The output of the first Op-amp 34 $V_o$ is connected to the gate of the n-type regulator transistor 36. With such configuration, the difference between the two input terminals, which voltage levels are VDD and VSENSE, of the Op-amp 34 is equal to $$VDD - VSENSE = \frac{V_o}{A}$$

wherein "A" is the gain of the first Op-amp 34. Such gain typically is normally larger than 1000 and up to 100,000 depending on the Op-am design, and thus $V_0$ is within the operating range of the integrated circuit chip containing the analogue external compensation unit 20, which is approximately a few volts. In this manner, the difference between the VDD and VSENSE is very small and essentially negligible.

As the pixel circuit drive transistor T1 is a p-type TFT, the current through OLED in first order is $$I_{OLED}=\beta(V_{DAT}-V_{DD}-V_{TH})^2 \text{ if VDD is connected}$$

$$I_{OLED}=\beta(V_{DAT}-V_{SENSE}-V_{TH})^2 \text{ if VSENSE is connected.}$$

When the applied VDAT voltage is the same and the VSENSE voltage level is the same as the VDD voltage level, the current that flows from the voltage supply VSENSE should be the exactly same as the current flow from the supply VDD. Accordingly, similarly as in the previous embodiment, when measuring the current flow through the duplicate power supply VSENSE, the sensed current should be similar to the current flow to the OLED during emission when the pixel is connected to the power supply VDD.

The OLED current $I_{OLED}$ flows through the n-type transistor 36 in the current regulator 26 to the current mirror 24 of the analogue external compensation unit 20. The first Op-amp 34 in the current regulator 26 adjusts the output voltage applied to the gate of the n-type transistor 36 to have the current value equal to the sensed OLED current $I_{OLED}$. This sensed current is then mirrored by the current mirror 24, and this mirrored current is inputted to the integrator 30 of the analogue external compensation system 20. The mirrored current of the current mirror 24, $I_{OLED_MIRROR}$, is compared with a programming reference current $I_{prog}$ from the current source 28, the programming reference current also being is inputted to the integrator 30. The difference between the mirrored OLED current, $I_{OLED_MIRROR}$ and the programming current, $I_{PROG}$ is thus applied to the integrator 30.

As referenced above and as also shown in FIG. 5, the integrator 30 may include a resistor 38, a capacitor 40 having capacitance C1, and a second Op-amp 42. The resistor 38 is connected between the positive input terminal of the second Op-amp 42 and a node "N" at which the mirrored OLED current $I_{OLED_MIRROR}$ and the programming reference current $I_{PROG}$ are connected. The capacitor 40 is connected between the positive input terminal of the second Op-amp 42 and the output of the second Op-amp 42. The negative terminal of the second Op-amp is connected to a reference voltage VREF that provides a DC voltage bias.

With such configuration, the relationship between the output of the integrator 30 and the current input to the integrator 30 is $$V_{out} = \frac{1}{C1}\int (I_{OLED_MIRROR} - I_{PROG})dt$$

The output of the integrator 30 is applied to the gate of the drive transistor T1 in the pixel circuit through the transistor T2 as an adjusted data voltage. As the data voltage is changing with the output of the integrator 30, the resultant controlled OLED current, $I_{OLED}$ is changing towards the programming reference current $I_{PROG}$. The output voltage $V_{out}$ of the integrator 30 continues rising or falling in the direction of forcing the OLED current, $I_{OLED}$ to be equal essentially to the programming current, $I_{PROG}$. When the current difference is smaller than the system resolution, the integrator output becomes a stable voltage, and the current sensing thereby compensates for any variations of the drive transistor and OLED properties.

As detailed above, during the current sensing and data programming phase, the current supplied from the current regulator to the first terminal of the pixel circuit is controlled by the adjusted data voltage based on forcing the current in a direction of toward the programming reference current. When a difference between the current supplied from the current regulator to the first terminal of the pixel circuit and the programming reference current becomes smaller than a resolution of the display system, the adjusted data voltage becomes a stable voltage. During the emission phase, the current through the light-emitting device approximates the programming reference current, and as referenced above, a level of the programming reference current corresponds to an image data grey level. In essence, therefore, during the current sensing and data programming phase, in this embodiment also a test current is applied through the first pixel terminal VSENSE to the OLED. The test current is mirrored and applied to the integrator for comparison to the programming reference current. As the currents are similar and optimally should be the same, the difference of the two currents is used to adjust the VDAT to an optimal level, and such voltage is applied via the second pixel terminal to the drive transistor of the pixel circuit. The adjusted and optimized VDAT is then used in the emission phase for light emission.

At the end of the current sensing and the data programming phase, the SCAN signal level is changed from the low voltage value to the high voltage value, causing transistors T2 and T3 to be turned off. With transistor T2 turning off, the VDAT input is disconnected from the gate of drive transistor T1, and the voltage VDAT is stored at the top plate of the storage capacitor $C_0$ for the emission phase. The bottom plate of the capacitor $C_0$ is connected to the power supply VDD. As described above, the VDAT voltage is the optimized voltage for the drive transistor to output the defined programming reference current. With transistor T3 turning off, the pixel is disconnected from the duplicate power supply VSENSE.

At the beginning of the emission phase, the EMI signal level is changed from the high voltage value to the low voltage value, causing transistor T4 to be turned on. With T4 turning on, the pixel is connected to the power supply VDD, and current will flow from VDD through the drive transistor T1 and to the OLED. The current flowing through the pixel is approximate to the programming reference current based on the operation during the current sensing and data programming phase. Accordingly, any threshold or mobility variations of the drive transistor and OLED are compensated and do not affect the programmed current in the pixel. The analogue external compensation system 20 sequentially operates to the next pixel for current sensing and data programming, until the pixels in the selected row are all sensed.

In this manner, the use of the analogue external compensation system provides for effective compensation of variations in the properties of the components of the pixel circuit, including in particular the drive transistor and light-emitting device (e.g., OLED). The compensation is performed effectively while maintaining a compact pixel circuit that is suitable for high resolution display devices.

An aspect of the invention, therefore, is a display system comprising a pixel circuit and an analogue external compensation system that is operable with the pixel circuit to compensate for differences in a property of the drive transistor and/or light-emitting device. In exemplary embodiments, the display system includes a pixel circuit having a drive transistor configured to control an amount of current to a light-emitting device depending upon a voltage applied to a gate of the drive transistor; and an analogue external compensation system that is operable with the pixel circuit. The analogue external compensation system includes a current regulator that regulates a current applied to a first terminal of the pixel circuit to approximate a current supplied through the drive transistor to the light-emitting device; a current mirror that receives the current from the current regulator and mirrors said current from the current regulator to output a mirrored current; a current source that supplies a programming reference current; and an integrator that receives inputs of the mirrored current and the programming reference current. The integrator converts a difference between the mirrored current and the programming reference current to an adjusted data voltage that is applied to a second terminal of the pixel circuit to compensate for a variation in a property of the drive transistor and/or the light-emitting device. The display system may include one or more of the following features, either individually or in combination.

In an exemplary embodiment of the display system, the current regulator comprises a first operational amplifier (Op-amp) and a regulator transistor, wherein: a positive input terminal of the first Op-amp is connected to a pixel voltage supply; a negative input terminal of the first Op-amp is connected to a first terminal of the regulator transistor and the first terminal of the pixel circuit; a second terminal of the regulator transistor is connected to the current mirror; and an output of the first Op-amp is connected to a gate of the regulator transistor.

In an exemplary embodiment of the display system, the regulator transistor is an n-type transistor.

In an exemplary embodiment of the display system, the integrator comprises a resistor, a capacitor, and a second Op-amp; wherein: a first terminal of the resistor is connected to the current source and a second terminal of the resistor is connected to a positive input of the second Op-amp and the capacitor; the capacitor is connected between the positive input of the second Op-amp and an output of the second Op-amp; a negative input of the second Op-amp is connected to a reference voltage supply that supplies a DC bias; and the output of the second Op-amp is connected to the second terminal of the pixel circuit.

In an exemplary embodiment of the display system, the light-emitting device is connected at a first node to a first terminal of the drive transistor and at a second node to a first voltage supply input; the pixel circuit further comprising: a second transistor having a first terminal connected to the gate of the drive transistor and a second terminal corresponding to the second terminal of the pixel circuit that receives the data voltage input supplied by the integrator of the analogue external compensation system, and a gate of the second transistor is connected to a first control signal; a third transistor having a first terminal connected to a second terminal of the drive transistor and a second terminal that corresponds to the first terminal of the pixel circuit that is connected to the current regulator of the analogue external compensation system, wherein a gate of the third transistor is connected to the first control signal; and a fourth transistor having a first terminal connected to the second terminal of the drive transistor and a second terminal connected to a second voltage supply input, wherein a gate of the fourth transistor is connected to a second control signal.

In an exemplary embodiment of the display system, the drive, second, third, and fourth transistors are n-type transistors.

In an exemplary embodiment of the display system, the drive, second, third, and fourth transistors are p-type transistors.

In an exemplary embodiment of the display system, the pixel circuit further comprises a storage capacitor connected to the gate of the drive transistor that stores the data voltage.

In an exemplary embodiment of the display system, the light-emitting device is one of an organic light-emitting diode, a micro light-emitting diode (LED), or a quantum dot LED.

In an exemplary embodiment of the display system, the system includes a display panel including an array of pixel circuits according to any of the embodiments arranged in rows and columns, wherein each column has a corresponding analogue external compensation system according to any of the embodiments.

In an exemplary embodiment of the display system, all pixel circuits within a given column are connected to the corresponding analogue external compensation system of said column.

Another aspect of the invention is a method of operating a display system comprising a pixel circuit according to any of the embodiments and an analogue external compensation system according to any of the embodiments. In exemplary embodiments, the method of operation includes the steps of: during a current sensing and data programming phase: disconnecting the drive transistor from a pixel voltage supply input and connecting the drive transistor to the analogue external compensation system via a first terminal of the pixel circuit; regulating with the current regulator a current applied to the first terminal of the pixel circuit to approximate a current supplied through the drive transistor to the light-emitting device; mirroring with the current mirror the current from the current regulator and outputting a mirrored current; supplying a programming reference current with the current source; and inputting the mirrored current and the programming reference current to the integrator, wherein the integrator converts a difference between the mirrored current and the programming reference current to an adjusted data voltage that is applied to a second terminal of the pixel circuit to compensate for a variation in a property of the drive transistor and/or the light-emitting device; and during an emission phase, disconnecting the drive transistor from the first terminal of the pixel circuit and connecting the drive transistor to the pixel voltage supply input, wherein the adjusted data voltage is applied to the gate of the drive transistor via the second terminal of the pixel circuit to control the current through the light emitting device. The method of operating may include one or more of the following features, either individually or in combination.

In an exemplary embodiment of the method of operating, during the current sensing and data programming phase, the current supplied from the current regulator to the first terminal of the pixel circuit is controlled by the adjusted data voltage based on forcing the current in a direction towards the programming reference current.

In an exemplary embodiment of the method of operating, when a difference between the current supplied from the current regulator to the first terminal of the pixel circuit and the programming reference current becomes smaller than a resolution of the display system, the adjusted data voltage becomes a stable voltage.

In an exemplary embodiment of the method of operating, during the emission phase the current through the light emitting device approximates the programming reference current.

In an exemplary embodiment of the method of operating, a level of the programming reference current corresponds to an image data grey level.

In an exemplary embodiment of the method of operating, the current regulator comprises a first operational amplifier (Op-amp) and a regulator transistor, wherein a positive input terminal of the first Op-amp is connected to the pixel voltage supply; a negative input terminal of the first Op-amp is connected to a first terminal of the regulator transistor and the first terminal of the pixel circuit; a second terminal of the regulator transistor is connected to the current mirror; and an output of the first Op-amp is connected to a gate of the regulator transistor; and the current supplied from the current regulator flows through the regulator transistor based on the output from the first Op-amp applied to the gate of the regulator transistor.

In an exemplary embodiment of the method of operating, the integrator comprises a resistor, a capacitor, and a second Op-amp; and a first terminal of the resistor is connected to the current source and a second terminal of the resistor is connected to a positive input of the second Op-amp and the capacitor; the capacitor is connected between the positive input of the second Op-amp and an output of the second Op-amp; a negative input of the second Op-amp is connected to a reference voltage supply that supplies a DC bias; and the output of the second Op-amp is connected to the second terminal of the pixel circuit.

In an exemplary embodiment of the method of operating, the method further includes: during the current sensing and data programming phase: placing the fourth transistor in an off state by operation of the second control signal to disconnect the drive transistor from the pixel voltage supply input; connecting the third transistor to the analogue external compensation system via the first terminal of the pixel circuit by operation of the first control signal to apply the current from the current regulator to the drive transistor; and connecting the second transistor to the analogue external compensation system via the second terminal of the pixel circuit by operation of the first control signal to apply the adjusted data voltage from the analogue external compensation system through the second transistor to the gate of the drive transistor; and during the emission phase, disconnecting the second and third transistors from the analogue external compensation system by operation of the first control signal, and placing the fourth transistor in an on state by operation of the second control signal to connect the drive transistor to the pixel voltage supply input.

In an exemplary embodiment of the method of operating, the method further includes storing the adjusted data voltage on a storage capacitor that is connected to the gate of the drive transistor.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—external compensation system
12—display panel
14—pixels
16—VDAT generation system
18—current measurement device
20—exemplary analogue external compensation system
22—first pixel circuit
24—current mirror
26—current regulator
28—current source
30—integrator
31—p-type transistor
32—p-type transistor
34—first operational amplifier (Op-amp)
36—regulator transistor
38—resistor
40—capacitor
42—second Op-amp
52—second pixel circuit
T1-T4—multiple transistors
OLED—organic light emitting diode (or generally light-emitting device)
C0—storage capacitor
C1—integrator capacitor
VDAT—data voltage
VDD—power supply
ELVSS—power supply
SCAN/EMI—control signals
VREF—reference voltage

What is claimed is:

1. A display system comprising:

a pixel circuit having a drive transistor configured to control an amount of current to a light-emitting device depending upon a voltage applied to a gate of the drive transistor; and an analogue external compensation system that is operable with the pixel circuit, the analogue external compensation system comprising:

a current regulator that regulates a current applied to a first terminal of the pixel circuit to approximate a current supplied through the drive transistor to the light-emitting device;

a current mirror that receives the current from the current regulator and mirrors said current from the current regulator to output a mirrored current;

a current source that supplies a programming reference current; and an integrator that receives inputs of the mirrored current and the programming reference current;

wherein the integrator converts a difference between the mirrored current and the programming reference current to an adjusted data voltage that is applied to a second terminal of the pixel circuit to compensate for a variation in a property of the drive transistor and/or the light-emitting device;

wherein the current regulator comprises a first operational amplifier (Op-amp) and a regulator transistor; and wherein:

a positive input terminal of the first Op-amp is connected to a pixel voltage supply;

a negative input terminal of the first Op-amp is connected to a first terminal of the regulator transistor and the first terminal of the pixel circuit;

a second terminal of the regulator transistor is connected to the current mirror; and an output of the first Op-amp is connected to a gate of the regulator transistor.

2. The display system of claim 1, wherein the regulator transistor is an n-type transistor.

3. The display system of claim 1, wherein the integrator comprises a resistor, a capacitor, and a second Op-amp; wherein:

a first terminal of the resistor is connected to the current source and a second terminal of the resistor is connected to a positive input of the second Op-amp and the capacitor;

the capacitor is connected between the positive input of the second Op-amp and an output of the second Op-amp;

a negative input of the second Op-amp is connected to a reference voltage supply that supplies a DC bias; and the output of the second Op-amp is connected to the second terminal of the pixel circuit.

4. The display system of claim 1, wherein the light-emitting device is connected at a first node to a first terminal of the drive transistor and at a second node to a first voltage supply input;

the pixel circuit further comprising:

a second transistor having a first terminal connected to the gate of the drive transistor and a second terminal corresponding to the second terminal of the pixel circuit that receives the data voltage input supplied by the integrator of the analogue external compensation system, and a gate of the second transistor is connected to a first control signal;

a third transistor having a first terminal connected to a second terminal of the drive transistor and a second terminal that corresponds to the first terminal of the pixel circuit that is connected to the current regulator of the analogue external compensation system, wherein a gate of the third transistor is connected to the first control signal; and a fourth transistor having a first terminal connected to the second terminal of the drive transistor and a second terminal connected to a second voltage supply input, wherein a gate of the fourth transistor is connected to a second control signal.

5. The display system of claim 4, wherein the drive, second, third, and fourth transistors are n-type transistors.

6. The display system of claim 4, wherein the drive, second, third, and fourth transistors are p-type transistors.

7. The display system of claim 1, wherein the pixel circuit further comprises a storage capacitor connected to the gate of the drive transistor that stores the data voltage.

8. The display system of claim 1, wherein the light-emitting device is one of an organic light-emitting diode, a micro light-emitting diode (LED), or a quantum dot LED.

9. A display system comprising a display panel including an array of pixel circuits according to claim 1 arranged in rows and columns, wherein each column has a corresponding analogue external compensation system according to claim 1.

10. The display system of claim 9, wherein all pixel circuits within a given column are connected to the corresponding analogue external compensation system of said column.

11. A display system comprising:

a pixel circuit having a drive transistor configured to control an amount of current to a light-emitting device depending upon a voltage applied to a gate of the drive transistor; and an analogue external compensation system that is operable with the pixel circuit, the analogue external compensation system comprising:

a current regulator that regulates a current applied to a first terminal of the pixel circuit to approximate a current supplied through the drive transistor to the light-emitting device;

a current mirror that receives the current from the current regulator and mirrors said current from the current regulator to output a mirrored current;

a current source that supplies a programming reference current; and an integrator that receives inputs of the mirrored current and the programming reference current;

wherein the integrator converts a difference between the mirrored current and the programming reference current to an adjusted data voltage that is applied to a second terminal of the pixel circuit to compensate for a variation in a property of the drive transistor and/or the light-emitting device; and wherein the light-emitting device is connected at a first node to a first terminal of the drive transistor and at a second node to a first voltage supply input;

the pixel circuit further comprising:

a second transistor having a first terminal connected to the gate of the drive transistor and a second terminal corresponding to the second terminal of the pixel circuit that receives the data voltage input supplied by the integrator of the analogue external compensation system, and a gate of the second transistor is connected to a first control signal;

a third transistor having a first terminal connected to a second terminal of the drive transistor and a second terminal that corresponds to the first terminal of the pixel circuit that is connected to the current regulator of the analogue external compensation system, wherein a gate of the third transistor is connected to the first control signal; and a fourth transistor having a first terminal connected to the second terminal of the drive transistor and a second terminal connected to a second voltage supply input, wherein a gate of the fourth transistor is connected to a second control signal.

12. A method of operating a display system comprising a pixel circuit and an analogue external compensation system that is operable with the pixel circuit, wherein the pixel circuit includes a drive transistor that supplies a current to a light-emitting device and the analogue external compensation system comprises a current regulator, a current mirror, a current source, and an integrator;

the method of operating comprising the steps of:

during a current sensing and data programming phase:

disconnecting the drive transistor from a pixel voltage supply input and connecting the drive transistor to the analogue external compensation system via a first terminal of the pixel circuit;

regulating with the current regulator a current applied to the first terminal of the pixel circuit to approximate a current supplied through the drive transistor to the light-emitting device;

mirroring with the current mirror the current from the current regulator and outputting a mirrored current;

supplying a programming reference current with the current source; and inputting the mirrored current and the programming reference current to the integrator, wherein the integrator converts a difference between the mirrored current and the programming reference current to an adjusted data voltage that is applied to a second terminal of the pixel circuit to compensate for a variation in a property of the drive transistor and/or the light-emitting device; and during an emission phase, disconnecting the drive transistor from the first terminal of the pixel circuit and connecting the drive transistor to the pixel voltage supply input, wherein the adjusted data voltage is applied to the gate of the drive transistor via the second terminal of the pixel circuit to control the current through the light emitting device.

13. The method of operating of claim 12, wherein during the current sensing and data programming phase, the current supplied from the current regulator to the first terminal of the pixel circuit is controlled by the adjusted data voltage based on forcing the current in a direction towards the programming reference current.

14. The method of operating of claim 13, wherein when a difference between the current supplied from the current regulator to the first terminal of the pixel circuit and the programming reference current becomes smaller than a resolution of the display system, the adjusted data voltage becomes a stable voltage.

15. The method of operating of claim 12, wherein during the emission phase the current through the light emitting device approximates the programming reference current.

16. The method of operating of claim 12, wherein a level of the programming reference current corresponds to an image data grey level.

17. The method of operating of claim 12, wherein:

the current regulator comprises a first operational amplifier (Op-amp) and a regulator transistor, wherein a positive input terminal of the first Op-amp is connected to the pixel voltage supply; a negative input terminal of the first Op-amp is connected to a first terminal of the regulator transistor and the first terminal of the pixel circuit; a second terminal of the regulator transistor is connected to the current mirror; and an output of the first Op-amp is connected to a gate of the regulator transistor; and the current supplied from the current regulator flows through the regulator transistor based on the output from the first Op-amp applied to the gate of the regulator transistor.

18. The method of operating of claim 12, wherein:

the integrator comprises a resistor, a capacitor, and a second Op-amp; and a first terminal of the resistor is connected to the current source and a second terminal of the resistor is connected to a positive input of the second Op-amp and the capacitor; the capacitor is connected between the positive input of the second Op-amp and an output of the second Op-amp; a negative input of the second Op-amp is connected to a reference voltage supply that supplies a DC bias; and the output of the second Op-amp is connected to the second terminal of the pixel circuit.

19. The method of operating of claim 12, wherein the light-emitting device is connected at a first node to a first terminal of the drive transistor and at a second node to a device voltage supply input;

wherein the pixel circuit further comprises:

a second transistor having a first terminal connected to the gate of the drive transistor and a second terminal corresponding to the second terminal of the pixel circuit that receives the data voltage input supplied by the integrator of the analogue external compensation system, and a gate of the second transistor is connected to a first control signal;

a third transistor having a first terminal connected to a second terminal of the drive transistor and a second terminal that corresponds to the first terminal of the pixel circuit that is connected to the current regulator of the analogue external compensation system, wherein a gate of the third transistor is connected to the first control signal; and a fourth transistor having a first terminal connected to the second terminal of the drive transistor and a second terminal connected to the pixel voltage supply input, wherein a gate of the fourth transistor is connected to a second control signal;

the method of operating further comprising the steps of:

during the current sensing and data programming phase:

placing the fourth transistor in an off state by operation of the second control signal to disconnect the drive transistor from the pixel voltage supply input;

connecting the third transistor to the analogue external compensation system via the first terminal of the pixel circuit by operation of the first control signal to apply the current from the current regulator to the drive transistor; and connecting the second transistor to the analogue external compensation system via the second terminal of the pixel circuit by operation of the first control signal to apply the adjusted data voltage from the analogue external compensation system through the second transistor to the gate of the drive transistor; and during the emission phase, disconnecting the second and third transistors from the analogue external compensation system by operation of the first control signal, and placing the fourth transistor in an on state by operation of the second control signal to connect the drive transistor to the pixel voltage supply input.

20. The method of operating of claim 19, further comprising storing the adjusted data voltage on a storage capacitor that is connected to the gate of the drive transistor.

* * * * *